US005604194A

United States Patent [19]

Cauwberghs et al.

[11] Patent Number: 5,604,194

[45] Date of Patent: Feb. 18, 1997

[54] STABLE LIQUID DETERGENT COMPOSITIONS COMPRISING SPECIFIC BRIGHTENER AND PVP TO INHIBIT DYE TRANSFER

[75] Inventors: Serge G. P. R. Cauwberghs, Nieuwkerken; Karel M. J. Depoot, Waregem, both of Belgium

[73] Assignee: The Procter & Gamble Company, Cincinnati, Ohio

[21] Appl. No.: 424,313

[22] PCT Filed: Nov. 16, 1993

[86] PCT No.: PCT/US93/11141

§ 371 Date: Apr. 26, 1995

§ 102(e) Date: Apr. 26, 1995

[87] PCT Pub. No.: WO94/11480

PCT Pub. Date: May 26, 1994

[30] Foreign Application Priority Data

Nov. 17, 1992 [CH] Switzerland ..... 3528/92

[51] Int. Cl.[6] ..... C11D 3/28; C11D 3/34; C11D 3/37; C11D 3/42

[52] U.S. Cl. ..... 510/325; 510/337; 510/357; 510/360; 510/394; 510/405; 510/426; 510/475; 510/496; 510/500

[58] Field of Search ..... 252/174.23, 524, 252/539, 542, 543, 558, DIG. 2, DIG. 14, DIG. 15; 510/325, 337, 357, 360, 394, 405, 426, 475, 496, 500

[56] References Cited

U.S. PATENT DOCUMENTS

| | | | |
|---|---|---|---|
| 3,000,830 | 9/1961 | Fong et al. | 252/117 |
| 4,507,219 | 3/1985 | Hughes | 252/118 |
| 4,559,169 | 12/1985 | Wevers et al. | 252/543 |
| 4,970,029 | 11/1990 | Halas | 252/549 |
| 5,106,523 | 4/1992 | Peterson et al. | 252/95 |
| 5,167,871 | 12/1992 | Jollenbeck et al. | 252/543 |
| 5,234,617 | 8/1993 | Hunter et al. | 252/102 |
| 5,279,772 | 1/1994 | Eckhardt et al. | 252/558 |
| 5,326,491 | 7/1994 | Weber et al. | 252/95 |

FOREIGN PATENT DOCUMENTS

| | | |
|---|---|---|
| 0394998 | 10/1990 | European Pat. Off. . |
| 1114606 | 4/1956 | Germany . |

OTHER PUBLICATIONS

Derwent Abstract accession No. 86-013463/02 for U.S. 4,559,169, Dec. 17, 1985.

*Primary Examiner*—Ardith Hertzog

*Attorney, Agent, or Firm*—Michael D. Jones; George W. Allen; Jerry J. Yetter

[57] ABSTRACT

A liquid detergent composition comprising (a) from 0.01 to 5 wt. % of a polyvinylpyrrolidone; (b) from 0.01 to 1 wt. % of a specific cotton-substantive brightener having structural formula (1) wherein $R_1$, $R_2$, $R_3$, $R_4$ and $R_5$ are independently selected from the following: a sulfonic acid radical, hydrogen, $C_1$–$C_4$ alkyl, $C_1$–$C_4$ alkoxy, halogen, CN, phenoxy or benzyloxy, under the condition that only one substituent can be sulfonic acid.

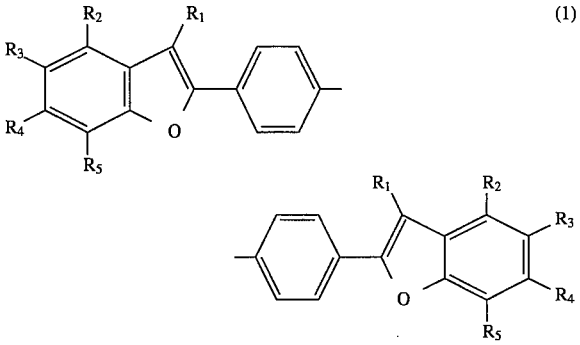

(1)

16 Claims, No Drawings

STABLE LIQUID DETERGENT COMPOSITIONS COMPRISING SPECIFIC BRIGHTENER AND PVP TO INHIBIT DYE TRANSFER

TECHNICAL FIELD

The present invention relates to liquid detergent compositions comprising cotton-substantive brighteners. More in particular, the present invention relates to stable liquid dye transfer inhibiting compositions comprising well-defined cotton-substantive brighteners.

BACKGROUND OF THE INVENTION

Cotton-substantive brighteners are commonly used in laundry detergents. Said brighteners deposit onto fabrics where they absorb ultraviolet radiant energy and reemit it as blue light. This reduces or eliminates any yellowish cast to fabrics and gives them a bright appearance. Examples of these brighteners are anionic brighteners with sulfonic acid group(s) e.g. mono- or di-sulfonic acid derivatives of bis-(tri-azinylamino)-stilbene, bis-(tri-azolyl)-stilbene and (sulfo styryl)-biphenyl.

However, it has been found to be difficult to avoid precipitation in liquid detergent compositions containing cotton-substantive brighteners in combination with polymers which exhibit dye transfer inhibiting properties. These polymers are used to complex or absorb the fugitive dyes washed out of dyed fabrics before they have the opportunity to become attached to other articles in the wash. Examples of such polymers that have been used within detergent compositions to inhibit dye transfer are vinylpyrrolidone polymers disclosed in EP-265 257 and EP-508 034.

Surprisingly, it has now been found that improved storage stability of liquid detergent compositions comprising vinylpyrrolidone polymers and cotton-substantive brighteners can be obtained by selecting well-defined type of cotton-substantive brighteners.

According to the present invention, a stable dye transfer inhibiting composition comprising a cotton-substantive brightener is provided which has improved stability upon storage.

SUMMARY OF THE INVENTION

The present invention relates to inhibiting dye transfer compositions comprising (a) from 0.01% to 5% of a polyvinyl pyrrolidone polymer;

(b) from 0.01% to 1% of a specific cotton-substantive brightener.

DETAILED DESCRIPTION OF THE INVENTION

The compositions of the present invention comprise as essential elements (a) from 0.01% to 5% of a polyvinyl pyrrolidone polymer;

(b) from 0.01% to 1% of a brightener having the following structural formula:

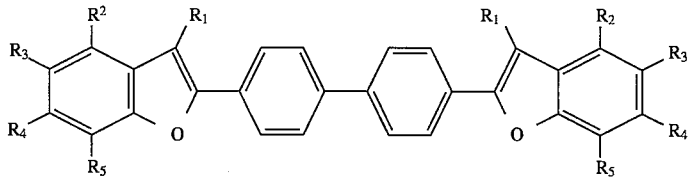

(1)

wherein R1, R2, R3, R4 and R5 independently is selected from a sulfonic acid, hydrogen C1–C4 alkyl, C1–C4 alkoxy, halogen, CN, phenoxy or benzyloxy, under the condition that only one substituent can be sulfonic acid.

(a) The polyvinylpyrrolidone

The detergent compositions herein contain a polyvinylpyrrolidone ("PVP", having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially vailable from GAF Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from GAF Corporation. Other suitable polyvinylpyrrolidones which are commercially available from BASF Corporation include Sokalan HP 165 and Sokalan HP 12. Polyvinylpyrrolidones are known to persons skilled in the detergent field; see for example EP-A-262,897 and EP-A-256,696. Th amount of polyvinylpyrrolidone used in the present detergent compositions should be from about 0.01% to about 5% by weight of the detergent, preferably from about 0.05% to about 3% by weight, and more preferably from about 0.1% to about 2% by weight. The amount of polyvinylpyrrolidone delivered in the wash solution is from about 0.5 ppm to about 250 ppm, preferably from about 2.5 ppm to about 150 ppm, more preferably from about 5 ppm about 100 ppm.

(b) Brightener

The detergent compositions herein contain a brightener having the following structural formula (1):

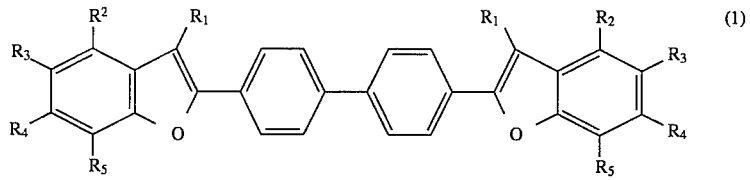

(1)

wherein R1, R2, R3, R4 and R5 independently can be selected from a sulfonic acid radical, hydrogen, C1–C4 alkyl, C1–C4 alkoxy, halogen, CN, phenoxy or benzyloxy, under the condition that only one substituent R1 to R5 can be a sulfonic acid radical.

Preferred halogens are fluorine, chlorine, bromine, highly preferred is chlorine.

The C1–C4 alkyl substituent, preferably C1–C4 alkoxy substituent, can be linear or branched. Said alkyl substituent, preferably the alkoxy substituents can be substituted by aryl(phenyl-, naphthyl-), C1–C4-alkyl-, C1–C4 alkoxy-, OH-or CN-groups.

Preferred brighteners are brighteners having formula (1) wherein

R1=$SO_3M$;

M=hydrogen or a non-chromophoric cation; and

R2, R3, R4, R5 independently can be selected from a hydrogen, C1–C4 alkyl, C1–C4 alkoxy, halogen, CN, phenoxy or benzyloxy.

Other preferred brighteners are those having formula (1) wherein

R1=hydrogen, C1–C4-alkyl, C1–C4-alkoxy, halogen, CN, phenoxy or benzyloxy;

R2, R3, R4 and R5 independently is a $SO_3M$, hydrogen, C1–C4-alkyl, C1–C4-alkoxy, halogen, CN, phenoxy or benzyloxy, under the condition that only one substituent can be sulfonic acid radical;

M=hydrogen or a non-chromophoric cation.

Highly preferred brighteners are those having formula (1) wherein

R4=$SO_3M$

R1, R2, R3 and R5 independently can be selected from a hydrogen, C1–C4-alkyl, C1–C4-alkoxy, halogen, CN, phenoxy of benzyloxy; and M=hydrogen or a non-chromophoric cation.

Other highly preferred brighteners are those having formula (1) wherein

R2=$SO_3M$;

R1, R3, R4 and R5 independently can be selected from a hydrogen, C1–C4-alkyl, C1–C4-alkoxy, halogen, CN,phenoxy or benzyloxy; and M=hydrogen or a non-chromophoric cation.

Particularly preferred brighteners are those having the formula (1) wherein $R_4$=$SO_3Na$; $R_1$ and $R_3$=methyl; and, $R_2$ and $R_5$=hydrogen; or $R_2$=$SO_3Na$; $R_3$ and $R_5$=methyl; and $R_1$ and $R_4$=hydrogen.

Preferred non-chromophoric cations can be selected from alkalimetals such as lithium, sodium, potassium or can be selected from substituted ammonium compounds such as ammonium, mono, di-or triethanolammonium, mono- di or tri propanol ammonium or tri or tetramethylammonium.

Highly preferred non-chromophoric cations are sodium, potassium and ammonium.

The brighteners are present in an amount of 0.01% to 1%, preferably 0.01% to 0.05% by weight of the detergent composition.

Detergent Ingredients

In another embodiment of the present invention, a liquid detergent composition is provided comprising the dye transfer inhibiting composition mixed with detergent ingredients. A wide range of surfactants can be used in the detergent composition of the present invention.

A typical listing of anionic, nonionic, ampholytic and zwitterionic classes, and species of these surfactants, is given in U.S. Pat. No. 3,664,961 issued to Norris on May 23, 1972.

Preferred anionic surfactants include the alkyl sulfate surfactants hereof and water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethylammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-18}$ alkyl chains and preferred for higher wash temperatures (e.g. above about 50° C.).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E (1.0)M), $C_{12}$–$C_{18}$ alkyl polyethoxylate (2.25) sulfate ($C_{12}$–$C_{18}$E (2.25)M), $C_{12}$–$C_{18}$ alkyl polyethoxylate (3.0) sulfate ($C_{12}$–$C_{18}$E (3.0)M), and $C_{12}$–$C_{18}$ alkyl polyethoxylate (4.0) sulfate ($C_{12}$–$C_{18}$E(4.0)M) , wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

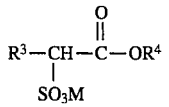

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$-$CH_2COO$-M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 3% to about 20% by weight of such anionic surfactants.

One class of nonionic surfactants useful in the present invention are condensates of ethylene oxide with a hydrophobic moiety to provide a surfactant having an average hydrophiliclipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO\,(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

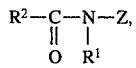

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R-CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Detergency builder salts are normally included in amounts of from 10% to 80% by weight of the composition, preferably from 20% to 70%, and most usually from 30% to 60% by weight.

Other components used in detergent compositions may be employed, such as enzymes and stabilizers or activators therefore, soil-suspending agents, soil-release polymers, other optical brighteners, abrasives, bactericides, tarnish inhibitors, coloring agents, foam control agents, corrosion inhibitors and perfumes. Especially preferred are combinations with enzyme technologies which also provide a type of color care benefit. Examples are cellulase for color maintenance/rejuvenation. Other examples are the polymers disclosed in EP 92870017.8 filed Jan. 31, 1992 and enzyme oxidation scavengers disclosed in EP 92870018.6 filed Jan. 31, 1992.

Also particulary suitable are amine base catalyst stabilizers disclosed in EP 92870019.4 filed Jan. 31, 1992.

Preferably the liquid compositions according to the present invention are in "concentrated form"; in such case, the liquid detergent compositions according to the present invention will contain a lower amount of water, compared to conventional liquid detergents. The level of water is less than 40%, preferably less than 30%, more preferably less than 20% of water by weight of the detergent compositions.

Said concentrated products provide advantages to the consumer, who has a product which can be used in lower amounts, and to the producer, who has lower shipping costs.

The following examples are meant to exemplify compositions of the present inventions, but are not necessarily meant to limit the scope of the invention.

Test Procedure

The stability of the liquid detergent compositions containing brightener and polyvinylpyrrolidone were measured for a selection of different brighteners. More in particular, the stability of polyvinylpyrrolidone (PVP K15)/ brightener was determined in the presence of the brightener having formula (1) and the commercially available brightener Blank for CPG 766 manufactured by Bayer.

The stability was determined by visual inspection of the samples after two weeks at 35° C. and one month of storage at room temperature.

Stable liquid detergent compositions contain the brightener in well-solubilised or homogeneously dispersed form. Complexation of the brightener with the polyvinylpyrrolidone can result in precipitation, leading to an unstable liquid detergent composition.

The following liquid detergent compositions were made:

| | I | II | III | IV |
|---|---|---|---|---|
| Linear alkylbenzene sulfonate | 18 | — | 6 | — |
| $C_{12}$-$C_{15}$ Alkyl sulfate | — | 16.0 | — | — |
| $C_{12}$-$C_{15}$ Alkyl ethoxylated sulfate | — | 11.0 | 4.0 | 25.0 |
| $C_{12}$-$C_{14}$ N-methyl glucamide | — | 7.0 | 9.0 | 9.0 |
| $C_{12}$-$C_{14}$ fatty alcohol ethoxylate | 12.0 | 5.0 | 6.0 | 6.0 |
| $C_{12}$-$C_{16}$ Fatty acid | 9.0 | 6.8 | 14.0 | 14.0 |
| Polyvinyl pyrrolidone | 1.0 | 1.0 | 1 | 1 |
| citric acid anhydrous | 6.0 | 4.5 | 3.5 | 3.5 |
| Diethylene triamine penta methylene phosphonic acid | 1.0 | 1.0 | 2.0 | 2.0 |
| Monoethanolamine | 13.2 | 12.7 | 12.8 | 11.00 |
| Propanediol | 12.7 | 14.5 | 13.1 | 10.0 |
| Ethanol | 1.8 | 1.8 | 4.7 | 5.4 |
| Enzymes | 2.4 | 2.4 | 2.0 | 2.0 |
| Terephthalate-based polymer | 0.5 | 0.5 | 0.5 | 0.5 |
| Boric acid | 2.4 | 2.4 | 2.8 | 2.8 |
| 2-butyl-Octanol | 2.0 | 2.0 | 2.0 | 2.0 |
| DC 3421 R (1) | 0.3 | 0.4 | 0.3 | 0.4 |
| FF 400 R (2) | | | | |
| Water & Minors | - - - up to 100% - - - | | | |

(1) DC 3421 is a silicone oil commercially available from Dow Corning.
(2) is a silicone glycol emulsifier available from Dow Corning.

The above compositions I–IV were each supplemented with a brightener according to formula (1) (A I, II, III, IV) and with brightener Blanko for LPG 766 (B I, II, III, IV).

Results:

| | A (I - IV) | B (I - IV) |
|---|---|---|
| Fresh | stable | stable |
| 2 Weeks 35° C. | stable | precipitation |
| 4 Weeks RT | stable | precipitation |

Liquid detergent compositions according to the present invention, containing the brightener/polyvinylpyrrolidone (A I, II, III, IV) system are stable, even after prolonged periods of storage. The brightener remains solubilised or homogeneously dispersed in the liquids, resulting in stable liquid detergent compositions.

In the compositions B I, II, III, IV, flocculation is observed, as the brightener starts to bind with the polyvinylpyrrolidone resulting in an insoluble complex.

What is claimed is:

1. A liquid detergent composition comprising:

(a) from 0.01% to 5% of a polyvinylpyrrolidone;

(b) from 0.01% to 1% of a brightener having formula (1)

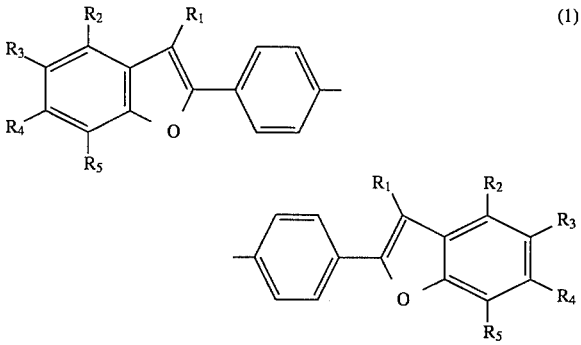

(1)

wherein $R_1$, $R_2$, $R_3$, $R_4$ and $R_5$ independently are selected from the group consisting of sulfonic acid radical, hydrogen, C1–C4 alkyl, C1–C4 alkoxy, halogen, -CN, phenoxy and benzyloxy, and only one substituent $R_1$ to $R_5$ is sulfonic acid radical; and (c) water in an amount of less than 20% by weight of the detergent composition.

2. A detergent composition according to claim 1 having a brightener of formula (1) wherein:

$R_1$=-$SO_3M$;

M=hydrogen or a non-chromophoric cation; and $R_2$, $R_3$, $R_4$, and $R_5$ independently are selected from the group consisting of hydrogen, C1–C4 alkyl, C1–C4 alkoxy, halogen, -CN, phenoxy and benzyloxy.

3. A detergent composition according to claim 1 having a brightener of formula (1) wherein:

$R_1$ is selected from the group consisting of hydrogen, C1–C4-alkyl, C1–C4-alkoxy, halogen, -CN, phenoxy or benzyloxy;

$R_2$, $R_3$, $R_4$, and $R_5$ independently are selected from the group consisting of -$SO_3M$, hydrogen, C1–C4-alkyl, C1–C4-alkoxy, halogen, -CN, phenoxy and benzyloxy; and M=hydrogen or a non-chromophoric cation.

4. A detergent composition according to claim 1 having a brightener of formula (1) wherein:

$R_4$=-$SO_3M$;

R1, R2, R3 and R5 independently are selected from the group consisting of hydrogen, C1–C4-alkyl, C1–C4-alkoxy, halogen, -CN, phenoxy and benzyloxy; and M=hydrogen or a non-chromophoric cation.

5. A detergent composition according to claim 1 having a brightener of formula 1 wherein:

R2=-$SO_3M$;

$R_1$, $R_3$, $R_4$, and $R_5$ independently are selected from a group consisting of hydrogen, C1–C4alkyl, C1–C4-alkoxy, halogen. -CN, phenoxy and benzyloxy; and M=hydrogen or a non-chromophoric cation.

6. A liquid detergent composition according to claim 1 having a brightener of formula (1) wherein one of $R_1$, $R_2$, $R_3$, $R_4$ or $R_5$, is -$SO_3M$; and M is selected from the group consisting of sodium, potassium and ammonium.

7. A liquid detergent composition according to claim 1 wherein the brightener has the formula (2)

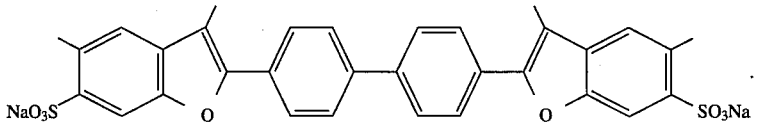

8. A liquid detergent composition according to claim 1 wherein the brightener has the formula (3)

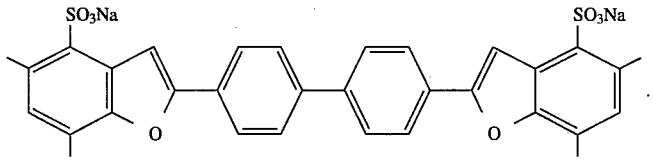

9. A detergent composition according to claim 1 wherein the polyvinylpyrrolidone is included in an amount of from about 0.1% to about 2% by weight of the composition.

10. A detergent composition according to claim 1 wherein the polyvinylpyrrolidone molecular weight is from about 2,500 to about 400,000.

11. A detergent composition according to claim 1 wherein the polyvinylpyrrolidone molecular weight is from about 5,000 to about 50,000.

12. A detergent composition according to claim 1 wherein the polyvinylpyrrolidone molecular weight is from about 5,000 to 15,000.

13. A liquid detergent composition according to claim 1 further comprising surfactant.

14. A detergent composition according to claim 13 wherein the surfactant is an anionic surfactant selected from the group consisting of alkyl alkoxylated sulfates, alkyl sulfates and mixtures thereof.

15. A detergent composition according to claim 13 further comprising detergency ingredients selected from the group consisting of builders, enzymes, enzyme stabilizers, enzyme activators, soil-suspending agents, soil-release polymers, other optical brighteners, abrasives, bactericides, tarnish inhibitors, coloring agents, foam control agents, corrosion inhibitors, perfumes, and mixtures thereof.

16. A method for washing fabrics, wherein said fabrics are washed with a detergent composition according to claim 1.

* * * * *